US007994697B2

(12) United States Patent
Park

(10) Patent No.: US 7,994,697 B2
(45) Date of Patent: Aug. 9, 2011

(54) LIGHT EMISSION DEVICE AND DISPLAY DEVICE USING THE LIGHT EMISSION DEVICE AS LIGHT SOURCE

(75) Inventor: Sang-Hun Park, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 381 days.

(21) Appl. No.: 12/207,387

(22) Filed: Sep. 9, 2008

(65) Prior Publication Data

US 2009/0066881 A1 Mar. 12, 2009

(30) Foreign Application Priority Data

Sep. 11, 2007 (KR) ..... 10-2007-0092123

(51) Int. Cl.
*H01J 1/62* (2006.01)

(52) U.S. Cl. ..... 313/495; 313/481; 313/549; 313/561

(58) Field of Classification Search ..... 313/481, 313/495–497, 545–547, 549, 553, 560, 561
See application file for complete search history.

(56) References Cited

U.S. PATENT DOCUMENTS

| | | | | |
|---|---|---|---|---|
| 2002/0033667 | A1* | 3/2002 | Yamashita | 313/553 |
| 2003/0071562 | A1* | 4/2003 | Ando | 313/496 |
| 2003/0090196 | A1* | 5/2003 | Ando | 313/495 |
| 2004/0217688 | A1* | 11/2004 | Hirasawa et al. | 313/497 |
| 2006/0250070 | A1* | 11/2006 | Seon et al. | 313/495 |
| 2008/0265770 | A1* | 10/2008 | Seon et al. | 313/556 |

FOREIGN PATENT DOCUMENTS

| | | |
|---|---|---|
| JP | 9-69346 | 3/1997 |
| KR | 2002-0076380 | 10/2002 |
| KR | 10-2006-0113108 | 11/2006 |
| KR | 10-2006-0118076 | 11/2006 |
| KR | 10-2007-0083117 | 8/2007 |

* cited by examiner

*Primary Examiner* — Bumsuk Won

(74) *Attorney, Agent, or Firm* — Christie, Parker & Hale, LLP

(57) ABSTRACT

A light emission device includes a vacuum chamber including a first substrate, a second substrate spaced from and facing the first substrate, and a sealing member between the first substrate and the second substrate. An electron emission unit is on the first substrate, the electron emission unit including a plurality of electron emission elements. A light emission unit is on the second substrate, the light emission unit including a phosphor layer. A barrier is spaced from the sealing member between the first substrate and the second substrate. At least one stud pin is fixed on at least one of the sealing member and the barrier and a getter unit is attached to the at least one stud pin, the getter unit fixed between the sealing member and the barrier.

18 Claims, 14 Drawing Sheets

LIGHT EMISSION DEVICE AND DISPLAY DEVICE USING THE LIGHT EMISSION DEVICE AS LIGHT SOURCE

CROSS-REFERENCE TO RELATED APPLICATION

This application claims priority to and the benefit of Korean Patent Application No. 10-2007-0092123 filed in the Korean Intellectual Property Office on Sep. 11, 2007, the entire content of which is incorporated herein by reference.

BACKGROUND OF THE INVENTION

1. Field of the Invention

The present invention relates to a light emission device having a getter in a vacuum chamber and a display device using the light emission device as a light source.

2. Description of the Related Art

There are many different types of light emission devices that radiate visible light. For example, a light emission device may include an anode electrode and a phosphor layer on a front substrate and electron emission regions, and driving electrodes on a rear substrate. The front and rear substrates are sealed to each other at their peripheries using a sealing member, and the inner space between the front and rear substrates is exhausted to form a vacuum chamber.

The electron emission regions emit electrons toward the phosphor layer, and the electrons excite the phosphor layer to cause the phosphor layer to emit visible light. In this case, the anode electrode functioning as an acceleration electrode receives a high voltage greater than several thousand volts and accelerates electrons to the phosphor layer.

When the light emission device is maintained at a high vacuum state, emission efficiency and a life-span of the electron emission regions may be improved. Accordingly, a conventional light emission device includes a getter in the vacuum chamber. After manufacturing the vacuum chamber, the getter is activated by a high frequency induction heating device to absorb or eliminate remaining gas in the vacuum chamber. The getter is usually fixed on an inactive area of either the front or rear substrates by a fixing agent.

However, since a fixing agent is required to fix each getter on the substrate, a configuration and an installation method thereof are complicated, outgassing may occur from the fixing agent to deteriorate a vacuum state, and fragments generated from the fixing agent may remain in the vacuum chamber. In addition, since the getter may be weak against external impact, the getter is easily moved or misshapen when impact or vibration is applied to the vacuum chamber.

The above information disclosed in this Background section is only for enhancement of understanding of the background of the invention and therefore it may contain information that does not form the prior art that is already known in this country to a person of ordinary skill in the art.

SUMMARY OF THE INVENTION

Aspects of the present invention provide a light emission device with a simplified getter configuration and getter installation method in which a fixing agent is omitted, wherein vacuum deterioration caused by outgassing and foreign particles may be eliminated, and a display device using the light emission device as a light source.

According to an embodiment of the present invention, a light emission device includes a vacuum chamber defined by a first substrate, a second substrate spaced from and facing the first substrate, and a sealing member extending between the first substrate and the second substrate. An electron emission unit is on a surface of the first substrate, the electron emission unit including a plurality of electron emission elements. A light emission unit is on a surface of the second substrate, the light emission unit including a phosphor layer. A barrier is spaced from the sealing member and extends between the first substrate and the second substrate. At least one stud pin is fixed on at least one of the sealing member and the barrier and a getter unit is attached to the at least one stud pin, the getter unit fixed between the sealing member and the barrier.

In one embodiment, the getter unit includes a getter container having a getter layer, and a first support fixed to the getter container, the first support being attached to the at least one stud pin. The first support may include a horizontal portion attached to the getter container, the horizontal portion being substantially parallel to the first substrate and to the second substrate, and a vertical portion extending at an angle from the horizontal portion, the vertical portion including a through-hole through which the at least one stud pin is inserted.

The getter unit may also include a plurality of getter containers, a plurality first supports for supporting the plurality of getter containers, and a second support located between and integral with a pair of adjacent getter containers of the plurality of getter containers to prevent relative movement between the pair of adjacent getter containers. When the plurality of getter containers are spaced along at least one of the sealing member and the barrier, one of the plurality of first supports and one of the at least one stud pins may be attached to only a first getter container and a last getter container of the plurality of getter containers.

In one embodiment, a plurality of stud pins may be on an inner surface of the sealing member and on a side surface of the barrier, wherein each of the plurality of stud pins on the inner surface of the sealing member is located directly opposite a corresponding stud pin of the plurality of stud pins on the side surface of the barrier. Alternatively, the stud pins on the sealing member and the barrier may alternate so that none of the stud pins are directly opposite each other. In one embodiment, a height of the barrier is about equal to a height of the sealing member. The electron emission element may be one selected from a field emission array (FEA) type and a surface-conduction emission (SCE) type, and the light emission unit may further include an anode electrode on a surface of the phosphor layer for receiving an anode voltage of between about 10 and 15 kV.

BRIEF DESCRIPTION OF THE DRAWINGS

The accompanying drawings, together with the specification, illustrate embodiments of the present invention, and, together with the description, serve to explain the principles of the present invention.

DETAILED DESCRIPTION

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

In embodiments of the present invention, a light emission device is understood to imply all devices for radiating visible light. Accordingly, light emission device as used herein includes display devices for transmitting information by displaying symbols, letters, numbers, and images. In addition, the light emission device may be used as a light source for providing light to a passive display panel.

Figure 1:
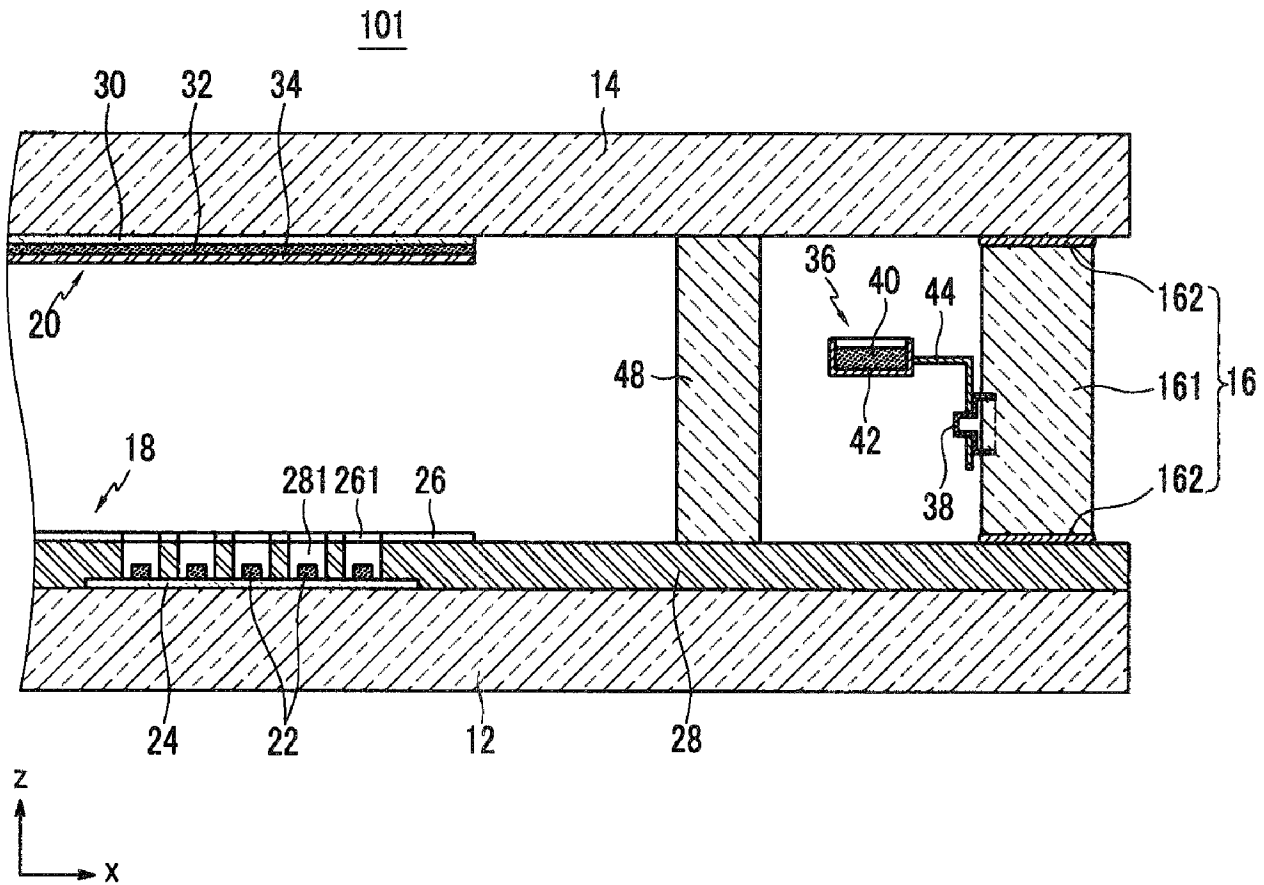
FIG. 1 is a cross-sectional view of a light emission device according to a first embodiment of the present invention.
Figure 2:
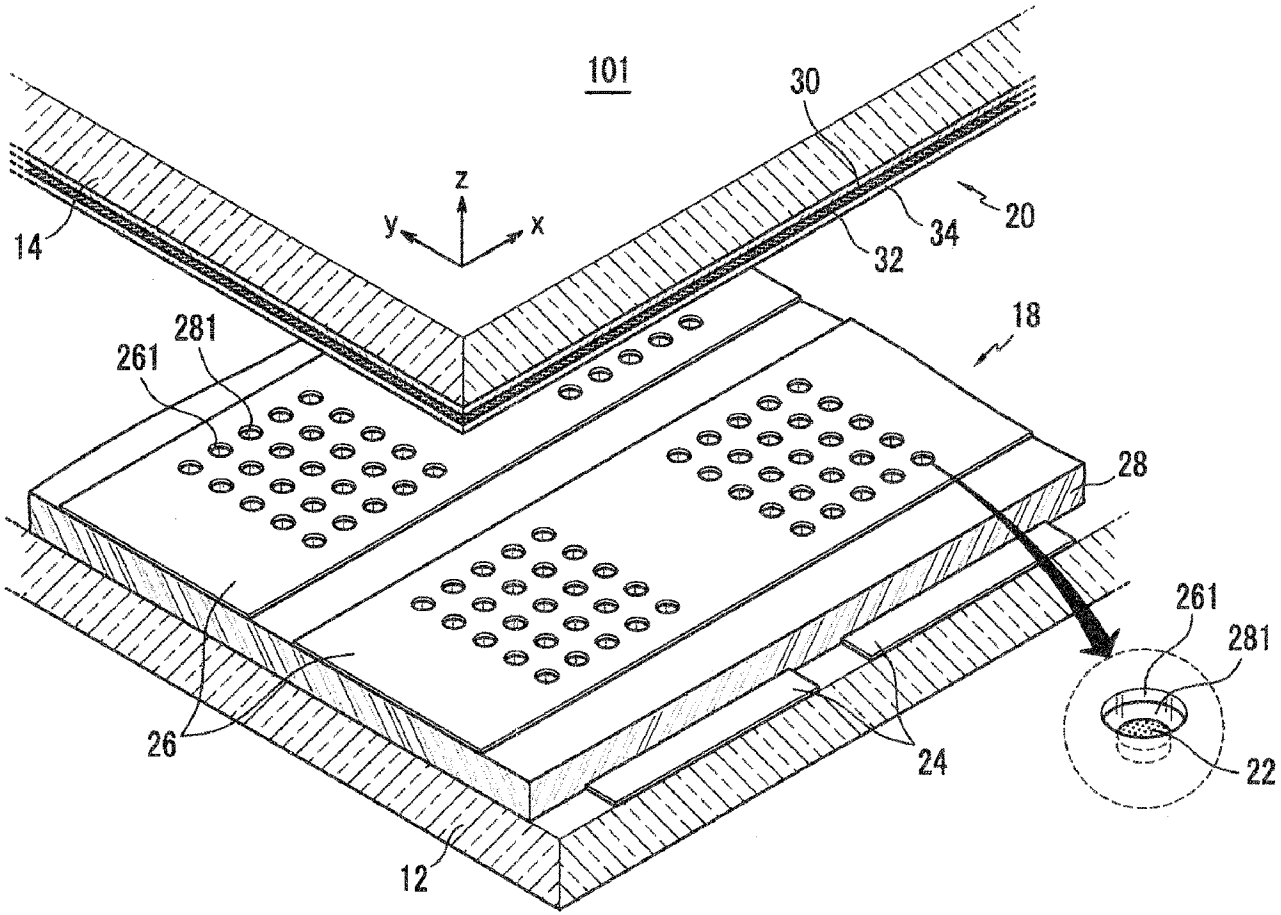
FIG. 2 is an exploded partial perspective view of an interior of an active area of the light emission device of FIG. 1.

FIG. 1 is a cross-sectional view of a light emission device according to a first embodiment of the present invention, and FIG. 2 is an exploded partial perspective view representing the inside of an active area of the light emission device show in FIG. 1.

As shown in FIG. 1 and FIG. 2, a light emission device 101 according to the first embodiment of the present invention includes a vacuum chamber defined by a first substrate 12 and a second substrate 14 spaced from and facing each other, and a sealing member 16 between the first substrate 12 and the second substrate 14 to combine the first and second substrates 12, 14. The interior of the vacuum chamber may be evacuated to a degree of vacuum of about $10^{-6}$ Torr.

Inside the vacuum chamber, the first and second substrates 12, 14 may be divided into an active area in which visible light is substantially emitted, and an inactive area surrounding the active area. An electron emission unit 18 including a plurality of electron emission elements is located in the active area on an inner surface of the first substrate 12, and a light emission unit 20 is located in the active area on an inner surface of the second substrate 14.

The second substrate 14 on which the light emission unit 20 is located may be a front substrate of the light emission device 101, and the first substrate 12 on which the electron emission unit 18 is located may be a rear substrate of the light emission device 101.

The electron emission unit 18 includes electron emission regions 22 and driving electrodes for controlling an amount of emission currents of the electron emission regions 22. The driving electrodes include cathode electrodes 24 formed in a stripe pattern along a direction (i.e., a y-axis direction shown in FIG. 2) of the first substrate 12, gate electrodes 26 formed in a stripe pattern along a direction (i.e., an x-axis direction shown in FIG. 2), crossing the cathode electrodes 24, and an insulation layer 28 being between the cathode electrodes 24 and the gate electrodes 26.

Openings 261, 281 are formed in the gate electrode 26 and the insulation layer 28, respectively, at crossing regions of the cathode and gate electrodes 24, 26, thereby partly exposing surfaces of the cathode electrodes 24, and the electron emission regions 22 are positioned on the cathode electrodes 24 in the insulation layer opening 281.

The electron emission regions 22 are composed of a material that can emit electrons when an electric field is applied under a vacuum atmosphere. For example, the electron emission regions 22 may be composed of a carbon-based material or a nanometer-sized material. In addition, the electron emission regions 22 may be composed of a material selected from the group consisting of carbon nanotubes, graphite, graphite nanofibers, diamond, diamond-like carbon, fullerene ($C_{60}$), silicon nanowires, and combinations thereof.

Alternatively, the electron emission regions may be formed into a structure having a sharp tip and using a material such as molybdenum (Mo) or silicon (Si).

In the above configuration, one cathode electrode 24, one gate electrode 26, and the electron emission regions 22 positioned at a crossing region of the cathode and gate electrodes 24, 26 may form one electron emission element. One electron or more emission elements may be positioned on one pixel area of the light emission device 101.

The light emission unit 20 includes an anode electrode 30, a phosphor layer 32 positioned on one surface of the anode electrode 30, and a reflective layer 34 covering the phosphor layer 32.

The anode electrode 30 is formed of a transparent conductive material such as indium tin oxide (ITO) for transmitting visible light emitted from the phosphor layer 32. The anode electrode 30 is an acceleration electrode for pulling electron beams and receives a positive direct current (DC) voltage (anode voltage) greater than several thousand volts to maintain the phosphor layer 32 in a high potential state.

The phosphor layer 32 may be made of a mixed phosphor of red, green, and blue phosphors to collectively emit white light. The phosphor layer 32 may be disposed on the entire active area of the second substrate 14 (FIGS. 1 and 2) or may be separately disposed for each pixel area.

The reflective layer 34 may be composed of a thin aluminum film with a thickness about several thousand Å, and includes tiny holes for transmitting the electron beams. The reflective layer 34 reflects visible light, emitted toward the first substrate 12 among the visible lights emitted from the phosphor layer 32, back to the second substrate 14 to increase luminance of the light emission device 101. In another embodiment, the anode electrode 30 may be absent, and instead the reflective layer 34 receives the anode voltage to function as the anode electrode.

Spacers for supporting against compression of the vacuum chamber and for maintaining a gap between the first and second substrates 12, 14 may be disposed in the active area between the first substrate 12 and the second substrate 14.

The above light emission device 101 applies a scan driving voltage to either the cathode electrode 24 or the gate electrode 26, applies a data driving voltage to the other electrode, and applies anode voltage greater than several thousand volts to the anode electrode 30.

Thereby, electric fields are formed around the electron emission regions 22 in pixels where a voltage difference between the cathode electrode 24 and the gate electrode 26 is greater than a threshold value, and electrons are emitted therefrom. The emitted electrons are pulled by the anode voltage applied to the anode electrode 30 to collide with the corresponding phosphor layer 32, thereby causing light emission. Luminance of the phosphor layer 32 for each pixel corresponds to the amount of emitted electrons of the corresponding pixel.

The light emission device 101 according to the first embodiment of the present invention includes a getter unit 36 fixedly provided to the vacuum chamber without using a fixing agent. Stud pins 38 are provided in the sealing member 16 to support the getter unit 36.

Figure 3:
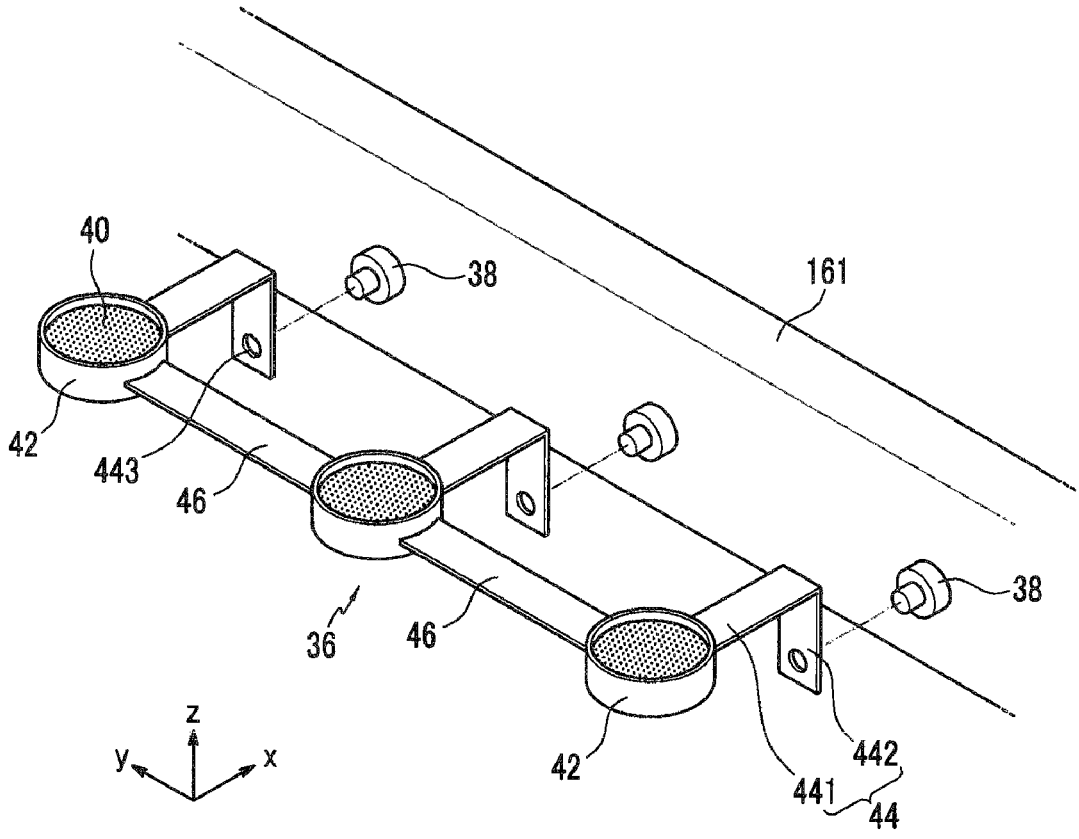
FIG. 3 is an exploded perspective view of a getter unit and a stud pin shown in FIG. 1.

FIG. 3 is an exploded perspective view of the getter unit and the stud pin 38 shown in FIG. 1. As shown in FIG. 1 and FIG. 3, the stud pins 38 are arranged on the sealing member 16 with intervals therebetween. Three stud pins 38 are illustrated in FIG. 3, but the number of stud pins 38 is not limited thereto.

The sealing member 16 includes a glass frame 161, and an adhesive layer 162 provided between the first substrate 12 and the glass frame 161 and between the second substrate 14 and the glass frame 161 to integrally combine the substrates 12, 14 and the glass frame 161. The glass frame 161 may be formed with a thickness of between about 5 and 20 mm, and the adhesive layer 162 includes a glass frit.

The stud pins 38 may be hollow, and may be formed of a metal having a thermal expansion coefficient that is similar to a thermal expansion coefficient of the glass frame 161. The stud pins 38 may be provided at an interior of the glass frame 161 to be fixed on the glass frame 161 when the glass frame 161 is manufactured.

The getter unit 36 includes at least one getter container 42 having a getter layer 40 and at least one first support 44 having a terminal fixed to the getter container 42 and another terminal attached to the stud pin 38.

Each first support 44 includes a substantially horizontal portion 441 fixed to a side surface of the getter container 42 and substantially parallel to the first substrate 12 and the second substrate 14, and a substantially vertical portion 442 substantially perpendicular to the horizontal portion 441 and including a through-hole 443 into which the stud pin 38 is inserted (for example, by interference fit). The getter container 42 is fixed to the interior of the sealing member 16 by the first support 44 such that the getter layer 40 faces the inner surface of the second substrate 14. In one embodiment, a getter container 42 and the first support 44 are provided for each stud pin 38.

The getter unit 36 may include a second support 46 provided between adjacent getter containers 42 to integrally fix the getter containers 42 and to substantially prevent relative movement between adjacent getter containers. The second support 46 maintains a gap between adjacent getter containers 42, and substantially prevents the getter containers 42 and the first supports 44 from being moved or vibrated when impact or vibration is applied to the vacuum chamber, thereby providing the getter unit 36 with a high resistance to external vibration and impact.

In one embodiment, when the second support 46 is provided to the getter unit 36, the stud pins 38 and the first supports 44 may be provided to only the outermost getter containers 42 of the getter unit 36. That is, when three or more getter containers 42 are integrally combined by two or more second supports 46, the first support 44 and the stud pin 38 for the middle getter containers 42 may be omitted.

The getter layer 40 may be composed of an evaporative or non-evaporative material. When the getter layer 40 is composed of an evaporative material, the getter layer may include at least one of barium (Ba), titanium (Ti), vanadium (V), zirconium (Zr), niobium (Nb), molybdenum (Mo), tantalum (Ta), barium-aluminum (Ba—Al), zirconium-aluminum (Zr—Al), silver-titanium (Ag—Ti), or zirconium-nickel (Zr—Ni). When the getter layer 40 is composed of a non-evaporative material, the getter layer 40 may include zirconium-vanadium-iron (Zr—V—Fe) or zirconium-aluminum (Zr—Al).

The vacuum chamber is manufactured by an assembly process and an evacuation process of the first substrate 12, the sealing member 16, and the second substrate 14, and the getter layer 40 may be activated by a high frequency induction heating device located outside the second substrate 14 after the evacuation process. The activated getter material absorbs and eliminates remaining gas in the vacuum chamber to improve a degree of vacuum.

When the getter layer 40 is composed of the evaporative getter material, a conductive getter material is evaporated in a getter activation process. Accordingly, a barrier 48 (FIG. 1) is provided between the getter unit 36 and the active area to prevent the getter material from infiltrating the active area.

The barrier 48 may have a height less than a gap between the first substrate 12 and the second substrate 14. Additionally, the barrier 48 may have a height substantially equal to the sealing member 16 (FIG. 1) and, in this case, the barrier 48 may be used as an auxiliary spacer for supporting a compressive force applied to the inactive area. In FIG. 1, it is illustrated that the barrier 48 has a height that is the same as the sealing member 16.

As described, the getter unit 36 is tightly fixed to the inside of the vacuum chamber by using a fastening force of the first supports 44 and the stud pins 38 without using a fixing agent. Accordingly, in the light emission device 101 according to the described embodiment of the present invention, foreign materials, debris and vacuum deterioration caused by the fixing agent may be eliminated, and the getter unit 36 may be easily assembled.

Figure 4:
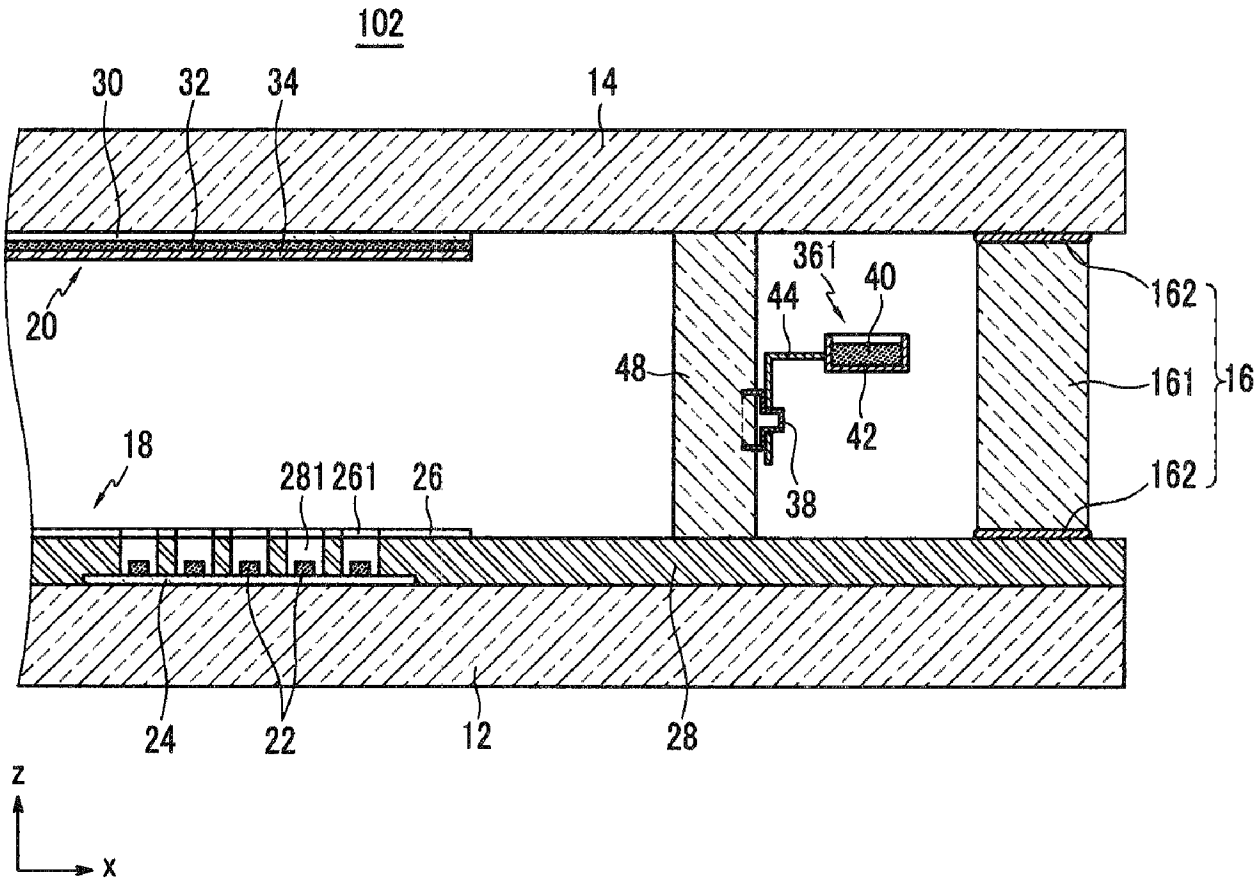
FIG. 4 is a cross-sectional view of a light emission device according to a second embodiment of the present invention.
Figure 5:
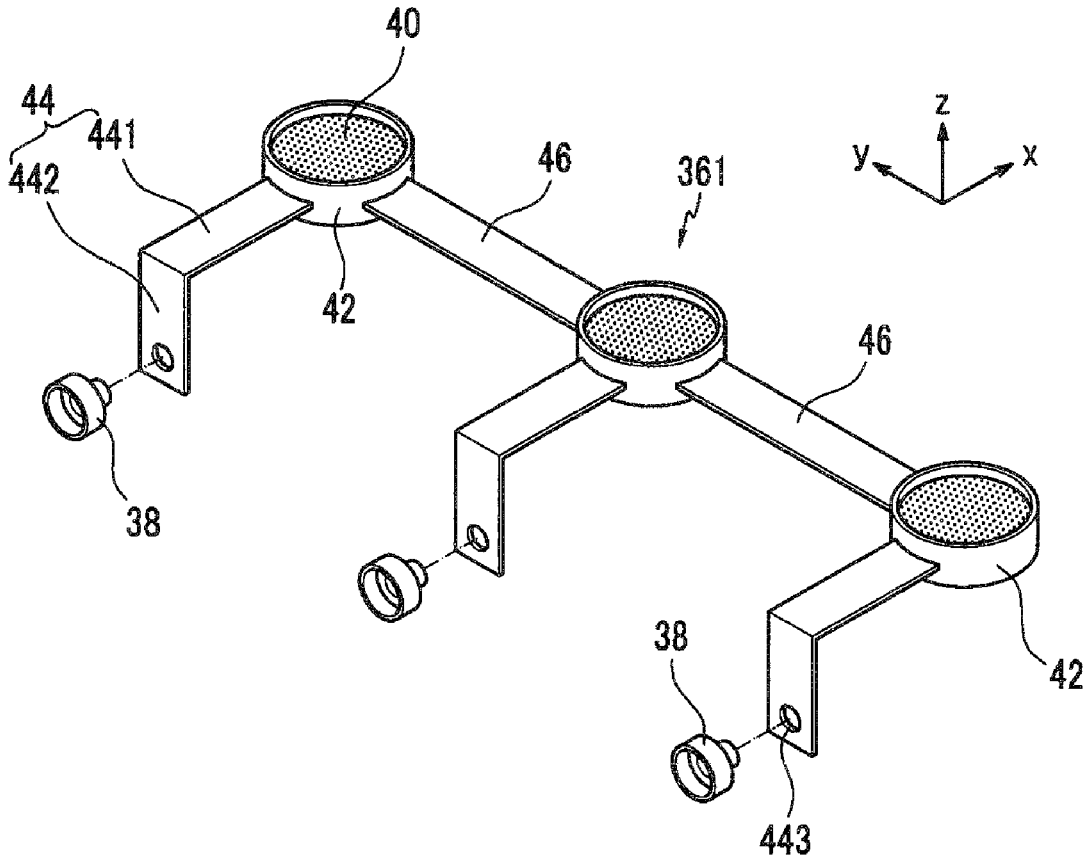
FIG. 5 is an exploded perspective view of a getter unit and a stud pin shown in FIG. 4.

FIG. 4 is a cross-sectional view of a light emission device according to a second embodiment of the present invention, and FIG. 5 is an exploded perspective view of a getter unit and a stud pin shown in FIG. 4. As shown in FIG. 4 and FIG. 5, a light emission device 102 according to the second embodiment of the present invention has substantially the same configuration as that of the first embodiment of the present invention except that the stud pins 38 are fixed on a side surface of the barrier 48 and the first support 44 is provided between the barrier 48 and the getter container 42. Like reference numerals are used for like elements as those of the first embodiment, and reference numeral 361 is used for the getter unit. The barrier 48 may be composed of the same material as the glass frame 161, and the stud pins 38 are provided to the side surface of the barrier 48 to be tightly fixed to the barrier 48 when the barrier 48 is manufactured.

Figure 6:
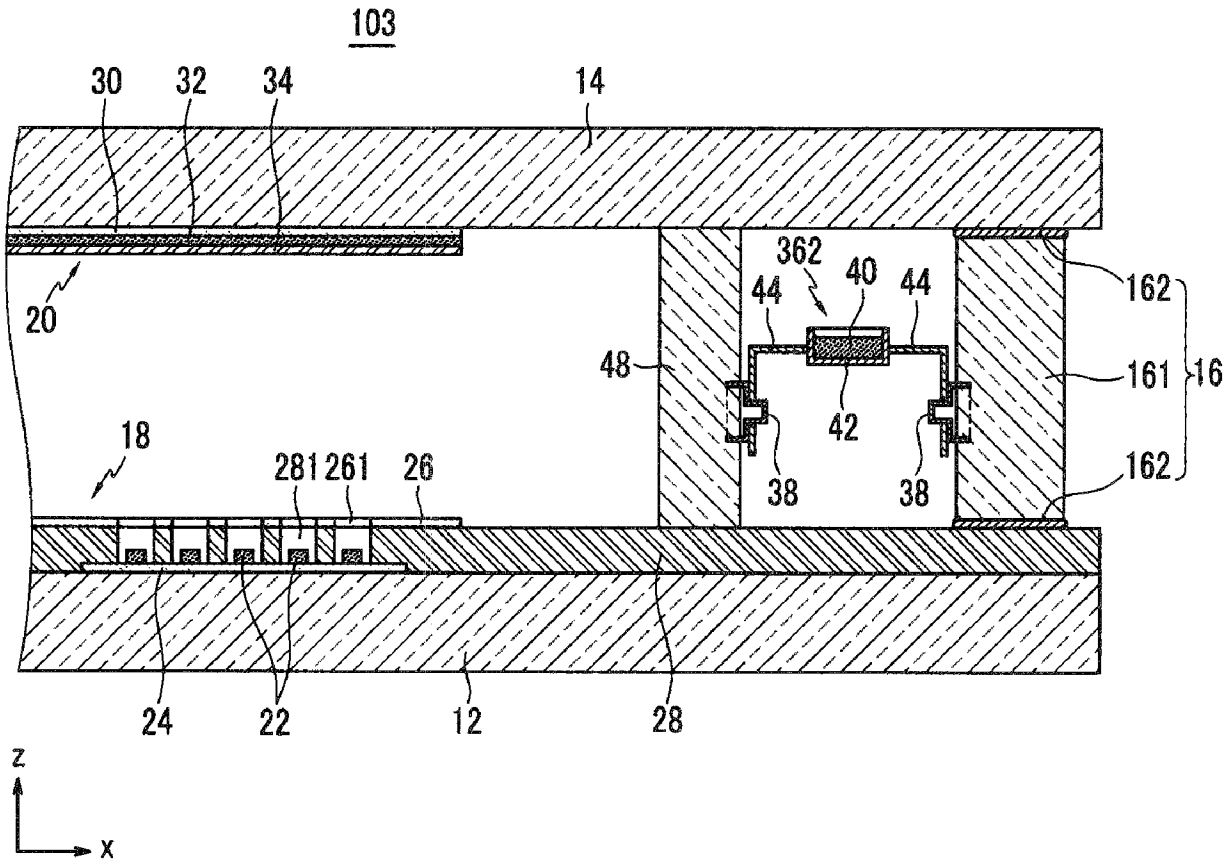
FIG. 6 is a cross-sectional view of a light emission device according to a third embodiment of the present invention.
Figure 7:
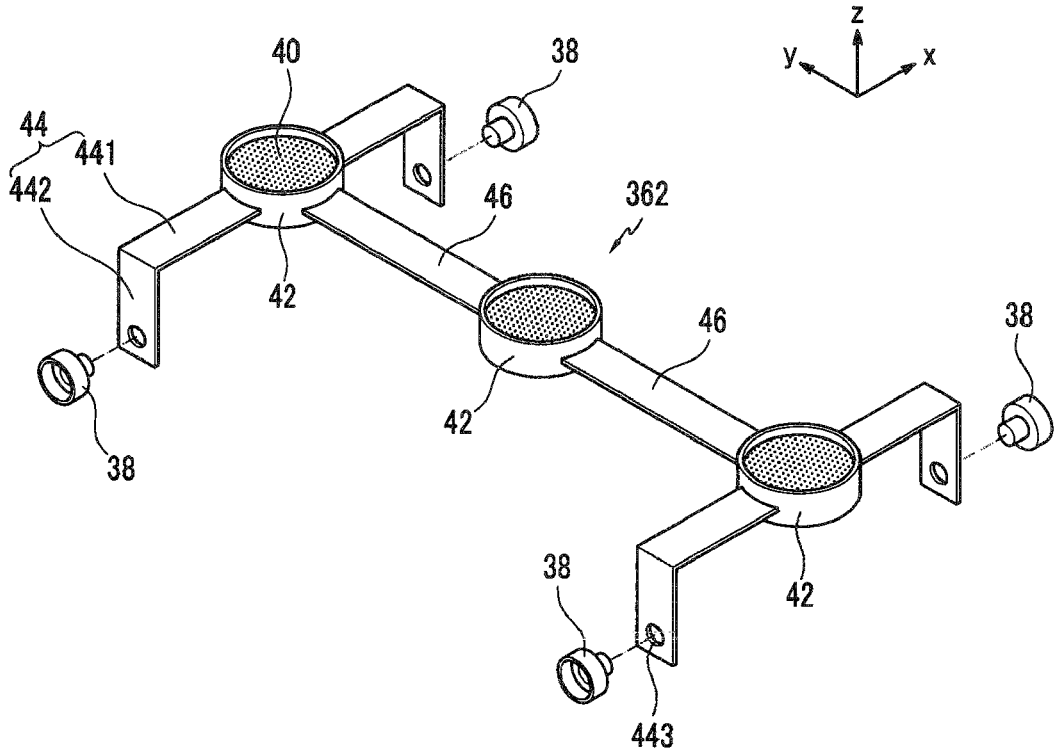
FIG. 7 is an exploded perspective view of a getter unit and a stud pin shown in FIG. 6.

FIG. 6 is a cross-sectional view of a light emission device according to a third embodiment of the present invention, and FIG. 7 is an exploded perspective view of a getter unit and a stud pin shown in FIG. 6. As shown in FIG. 6 and FIG. 7, a light emission device 103 according to the third embodiment of the present invention is substantially the same as the first embodiment of the present invention except that the stud pins 38 are fixed on an inner surface of the glass frame 161 and the side surface of the barrier 48 such that the stud pins 38 face each other, and first supports 44 are provided on two sides of the getter container 42. Like reference numerals are used for like elements of the first embodiment, and reference numeral 362 is used for the getter unit.

The stud pins 38 fixed on the glass frame 161 and the stud pins 38 fixed on the barrier 48 are arranged opposite to each other in a direction (an x-axis direction shown in FIG. 7) of the first substrate 12, and the first supports 44 are provided on two sides of the getter containers 42 such that the stud pins 38 fixed on the glass frame 161 and the barrier 48 are inserted into through-holes 443 thereof.

In one embodiment, when three or more getter containers 42 are integrally fixed by the second support 46, the first support 44 and the stud pin 38 for the middle getter container 42 may be omitted.

Figure 8:
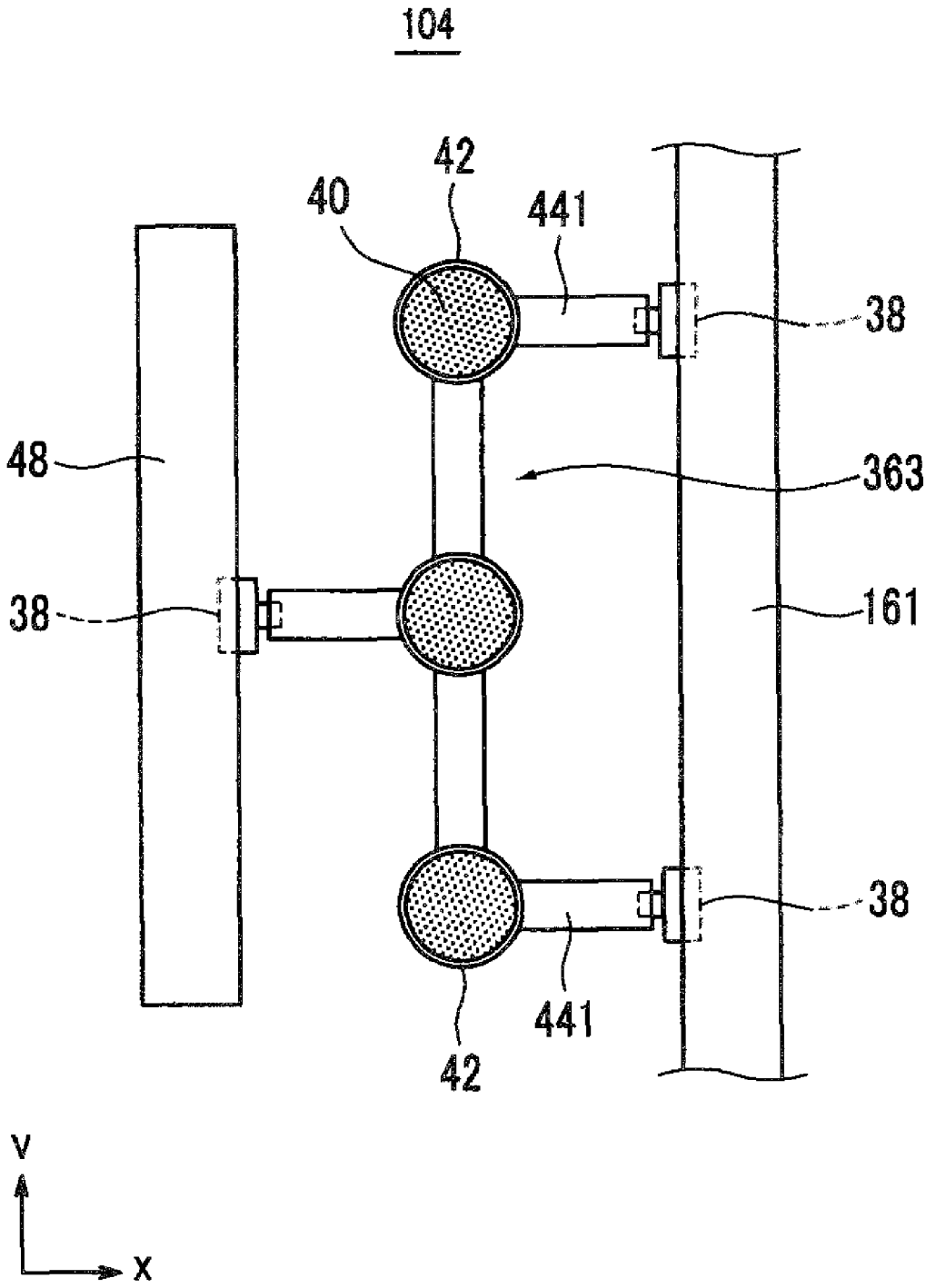
FIG. 8 is a top plan view of a light emission device according to a fourth embodiment of the present invention.
Figure 9:
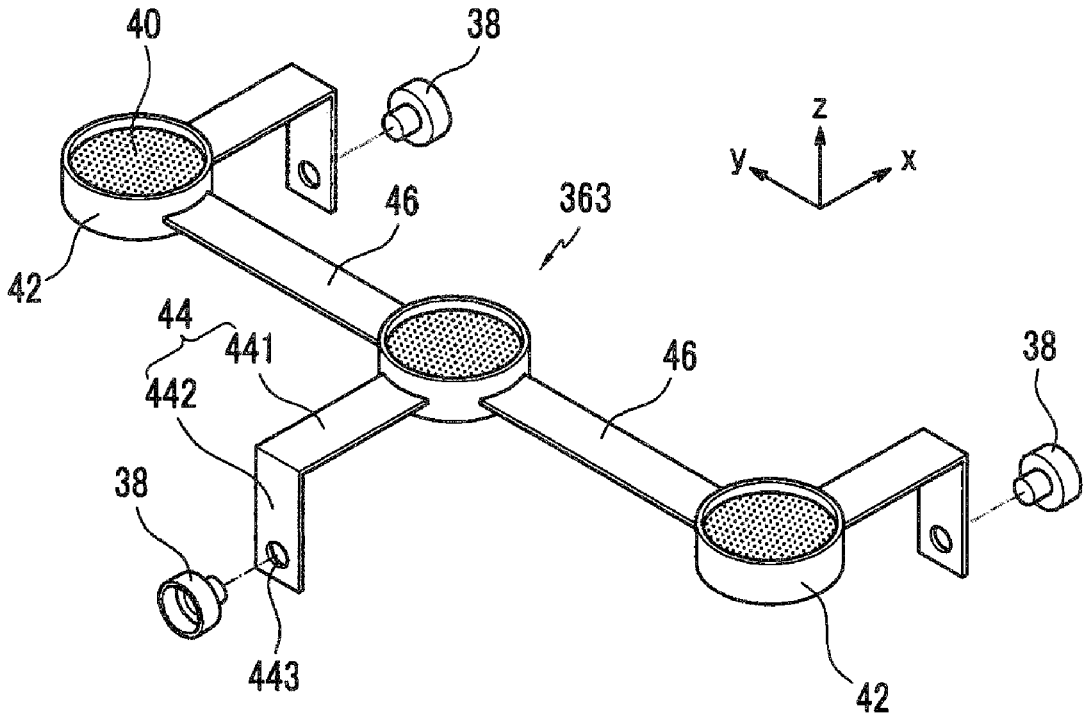
FIG. 9 is an exploded perspective view of a getter unit and a stud pin shown in FIG. 8.

FIG. 8 is a top plan view of a light emission device according to a fourth embodiment of the present invention, and FIG. 9 is an exploded perspective view of a getter unit and a stud pin shown in FIG. 8. As shown in FIG. 8 and FIG. 9, a light emission device 104 according to the fourth embodiment of the present invention is substantially the same as the first embodiment of the present invention except that the stud pins 38 are alternately fixed on the inner surface of the glass frame 161 and the side surface of the barrier 48, and the first support 44 is disposed between the stud pin 38 and the getter container 42 for each getter container 42. Like reference numerals are used for like elements as those of the first embodiment, and reference numeral 363 is used for the getter unit.

As shown in FIG. 8 and FIG. 9, three getter containers 42 are integrally fixed by the second support 46, and two stud pins 38 are positioned on the inner surface of the glass frame 161, and one stud pin 38 is provided on the side surface of the barrier 48. In addition, in another embodiment, an additional getter container may be provided on the second support 46. In this case, the capacity of getter layers of the getter unit may be easily increased.

The above light emission devices 101, 102, 103, and 104 may be used as a light source for providing light to a passive display panel in a display device. In the light emission device used as the light source, the first substrate 12 and the second substrate 14 may be positioned with a considerable gap of between about 5 and 20 mm therebetween. If a gap between the first substrate 12 and the second substrate 14 is increased, arc discharge in the vacuum chamber may be reduced, and high luminance may be generated when a voltage greater than 10 kV to the anode electrode 30 is applied.

Figure 10:
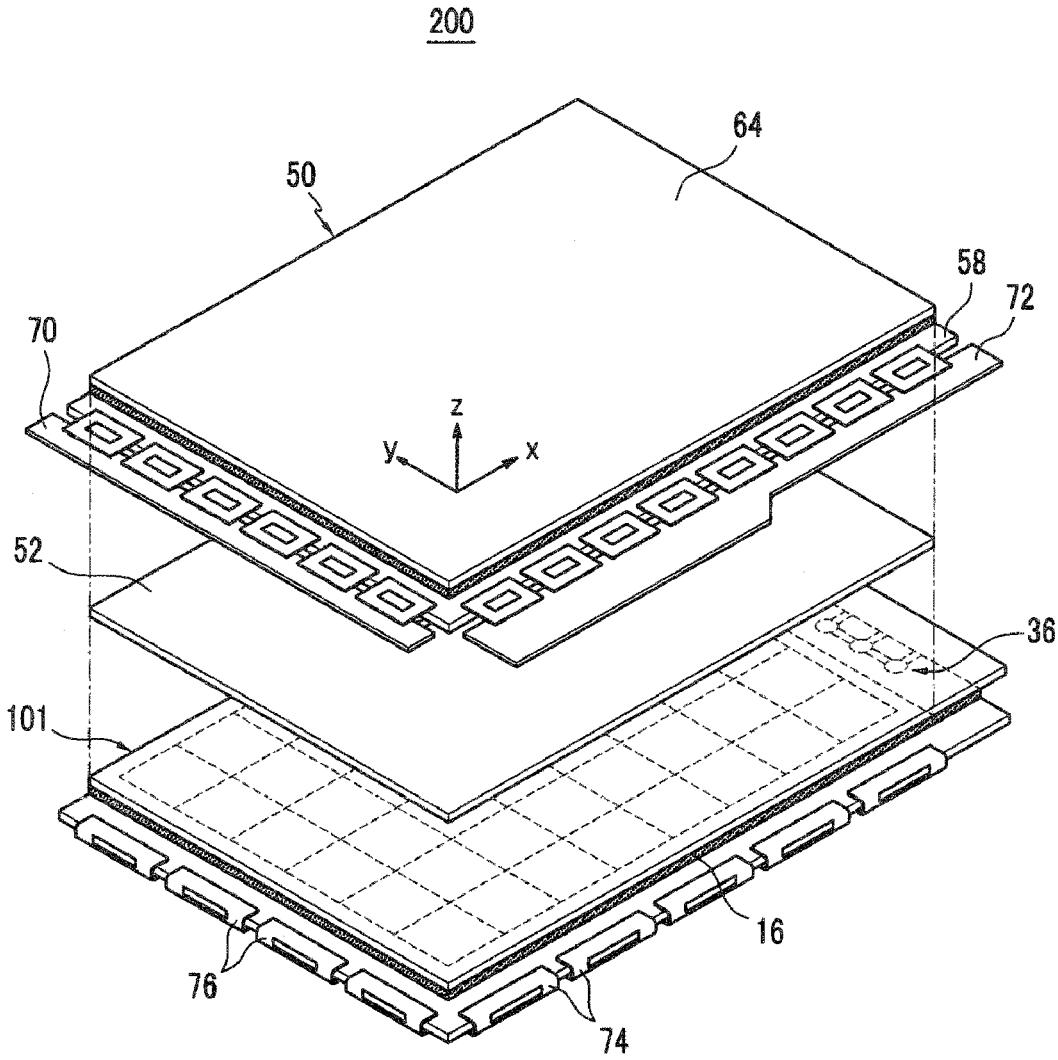
FIG. 10 is an exploded perspective view of a display device according to an embodiment of the present invention.
Figure 11:
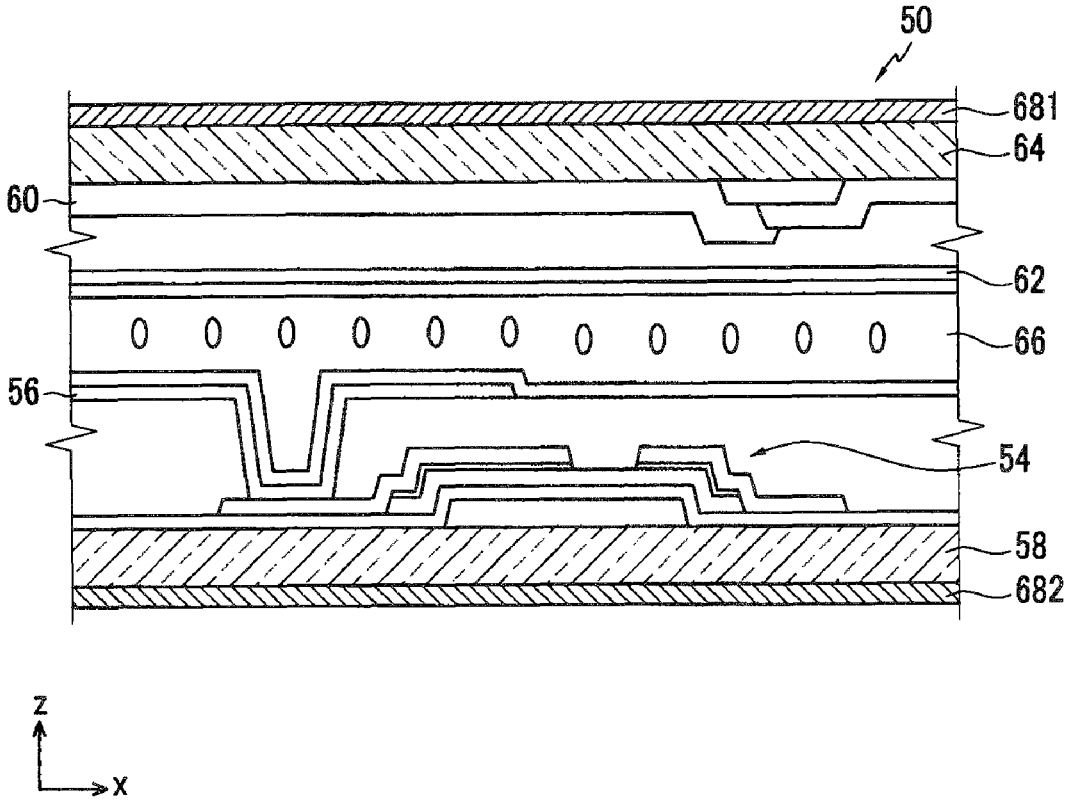
FIG. 11 is a cross-sectional view of a display panel shown in FIG. 10.

FIG. 10 is an exploded perspective view of a display device according to one embodiment of the present invention, and FIG. 11 is a cross-sectional view of a display panel shown in FIG. 10. As shown in FIG. 10, a display device 200 according to the embodiment of the present invention includes a light emission device 101, and a display panel 50 provided in front of the light emission device 101. A light diffuser 52 for evenly diffusing light emitted from the light emission device 101 may be provided between the light emission device 101 and the display panel 50, and the light diffuser 52 and the light emission device 101 are spaced from each other.

The display device 200 includes one of the light emission devices according to the first to fourth embodiments of the present invention. The light emission device 101 according to the first embodiment of the present invention is illustrated in FIG. 10. The display panel 50 may be a liquid crystal display panel or another passive display panel. The display panel 50 as a liquid crystal display panel will now be described.

As shown in FIG. 11, the display panel 50 includes a lower substrate 58 on which thin film transistors (TFTs) 54 and pixel electrodes 56 are formed, an upper substrate 64 on which a color filter layer 60 and a common electrode 62 are formed, and a liquid crystal layer 66 provided between the upper substrate 64 and the lower substrate 58. Polarizing plates 681, 682 are provided on an upper surface of the upper substrate 64 and a lower surface of the lower substrate 58, respectively, to polarize the light transmitted through the display panel 50.

The pixel electrode 56 is positioned in each sub-pixel, and is controlled by the TFT 54. The pixel electrodes 56 and the common electrode 62 are formed of transparent materials. The color filter layer 60 includes a red filter layer, a green filter layer, and a blue filter layer for each sub-pixel.

When the TFT 54 of a sub-pixel is turned on, an electric field is formed between the pixel electrode 56 and the common electrode 62, and the arrangement angles of liquid crystal particles changes according to the electric field. Therefore, light transmittance varies with the changed arrangement angle. The display panel 50 can control the luminance and emitting color of each pixel through this process described above.

In FIG. 10, reference numeral 70 denotes a gate circuit board assembly for transmitting a gate driving signal to a gate electrode of each TFT 54, and reference numeral 72 denotes a data circuit board assembly for transmitting a data driving signal to the source electrode of each TFT 54.

Referring to FIG. 10, the light emission device 101 includes fewer pixels than the display panel 50 so as to correspond to a single pixel of the light emission device 101 to two or more pixels of the display panel 50. Each pixel of the light emission device 101 can emit light corresponding to the highest grayscale level among a plurality of pixels of the display panel 50, and can express 2 to 8 bits of the grayscale.

For convenience, a pixel of the display panel 50 is referred to as a first pixel, and a pixel of the light emission device 101 is referred to as a second pixel. First pixels corresponding to one second pixel are referred to as a first pixel group.

A method for driving the light emission device 101 may include ① detecting the highest grayscale level among the first pixels of the first pixel group at a signal controller (not shown) controlling the display panel 50, ② calculating a grayscale level for the second pixel to emit light according to the detected grayscale level and converting the calculated grayscale level to digital data, ③ generating a driving signal of the light emission device 101 using the digital data, and ④ applying the generated driving signal to the driving electrode of the light emission device 101.

The driving signal of the light emission device 101 includes a scan driving signal and a data driving signal. The cathode electrodes or the gate electrodes receive the scan driving signal, and the others of the cathode electrodes or the gate electrodes receive the data driving signal.

A scan circuit board assembly and a data circuit board assembly may be disposed at a rear surface of the light emission device 101 for driving the light emission device 101. In FIG. 10, reference numeral 74 denotes a first connector for connecting the cathode electrodes and the data circuit board assembly, and reference numeral 76 denotes a second connector for connecting the gate electrodes and a scan circuit board assembly. The anode electrode is connected to a third connector to receive the anode voltage through the third connector.

The second pixel of the light emission device 101 is synchronized with the first pixel group and emits light at a grayscale level when an image is displayed on the corresponding first pixel group. That is, the light emission device 101 provides light with high luminance to a bright area of the display panel 50 and provides light with low luminance to a dark area of the display panel 50. Accordingly, the display device 200 according to the embodiment of the present invention can increase the contrast ratio of the screen and provide sharp image quality.

Figure 12:
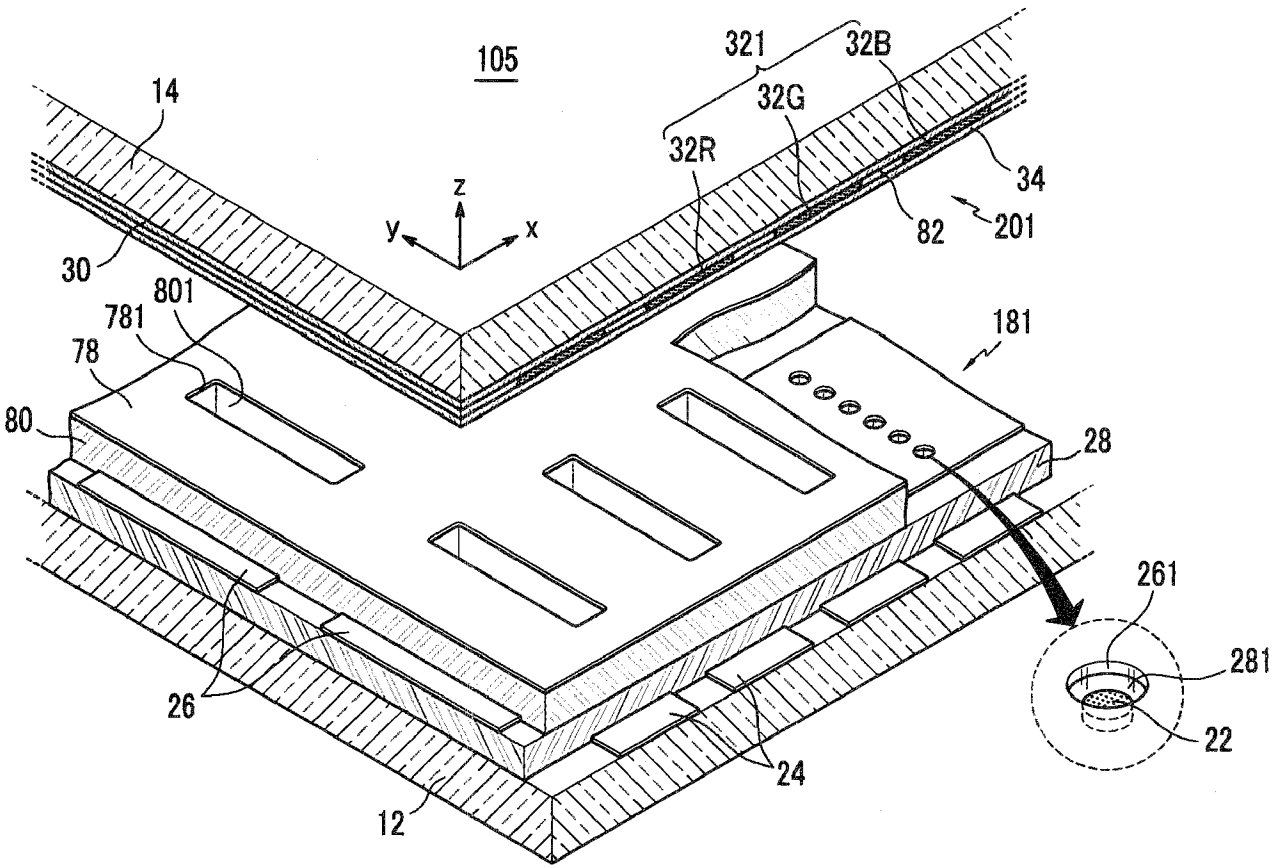
FIG. 12 is an exploded partial perspective view of a light emission device according to a fifth embodiment of the present invention.

FIG. 12 is an exploded partial perspective view of a light emission device according to a fifth embodiment of the present invention. Like reference numerals are used for like elements of the first embodiment. As shown in FIG. 12, in a light emission device 105 according to the fifth embodiment of the present invention, an electron emission unit 181 further includes a focusing electrode 78 positioned on the gate electrodes 26. When the insulation layer 28 positioned between the cathode electrode 24 and the gate electrode 26 is referred to as a first insulation layer, a second insulation layer 80 is provided between the gate electrodes 26 and the focusing electrode 78. The second insulation layer 80 and the focusing electrode 78 include openings 801 and 781 through which the electron beam is transmitted. The focusing electrode 78 receives a ground voltage or several to tens of negative DC volts to focus electrons transmitted through the focusing electrode opening 781.

A size of a crossing region of the cathode electrode 24 and the gate electrode 26 may be smaller than a size of the crossing region of the first embodiment of the present invention, and the number of electron emission regions 22 positioned on each crossing region of the present embodiment may be less than the number of electron emission regions 22 positioned on each crossing region of the first embodiment.

The light emission unit 201 includes a red phosphor layer 32R, a green phosphor layer 32G, and a blue phosphor layer 32B spaced from each other, and a black layer 82 provided between respective phosphor layers 321. The crossing region of the cathode electrode 24 and the gate electrode 26 may correspond to one sub-pixel, and the respective red, green, and blue phosphor layers 32R, 32G, and 32B are positioned to correspond to one sub-pixel. Three sub-pixels in which the red phosphor layer 32R, the green phosphor layer 32G, and the blue phosphor layer 32B are arranged form one pixel.

The amount of emitted electrons of the electron emission regions 22 for each sub-pixel is determined by a driving voltage applied to the cathode electrode 24 and the gate electrode 26, and the electrons collide with the phosphor layers 32R, 32G, and 32B of the corresponding sub-pixel to excite the phosphor layer 321. The light emission device 105 controls pixel luminance and light emission colors to realize a color screen.

In the light emission device 105 according to the fifth embodiment of the present invention, a configuration of a getter unit provided between a sealing member and a barrier is substantially the same as in previously described embodiments of the present invention.

While it has been illustrated that the electron emission unit is a field emission array (FEA) type, it may also be formed as a surface-conduction emission (SCE) type.

Figure 13:
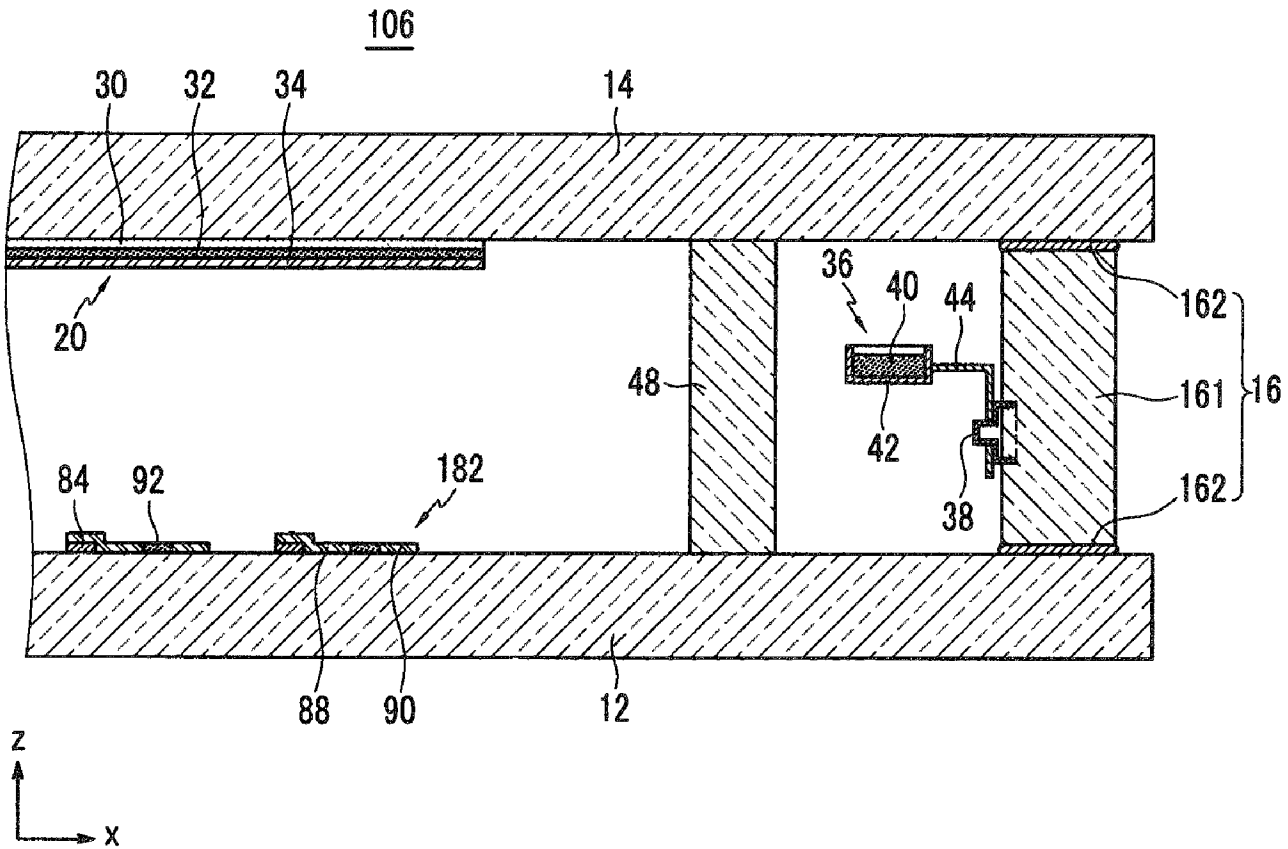
FIG. 13 is a cross-sectional view of a light emission device according to a sixth embodiment of the present invention.
Figure 14:
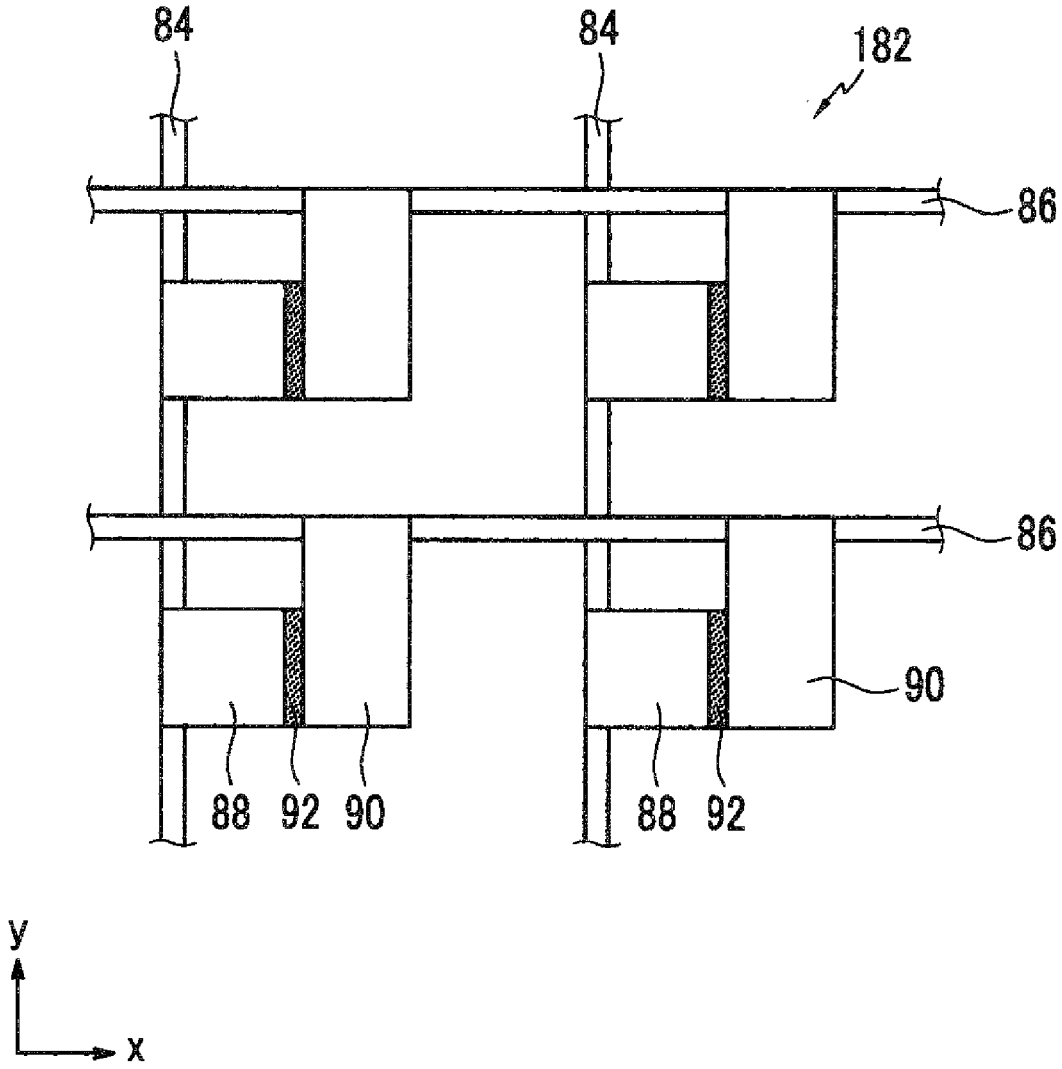
FIG. 14 is a partial top plan view of an electron emission unit shown in FIG. 13.

FIG. 13 is a cross-sectional view of a light emission device according to a sixth embodiment of the present invention, and FIG. 14 is a partial top plan view of an electron emission unit shown in FIG. 13. As shown in FIG. 13 and FIG. 14, a light emission device 106 according to the sixth embodiment of the present invention is substantially the same as the light emission devices according to those of the first through fifth embodiments, except that the electron emission unit 182 is an SCE type.

The electron emission unit 182 includes first electrodes 84 formed in a stripe pattern along a direction of the first substrate 12 (a y-axis direction shown in FIG. 14), second electrodes 86 formed in a stripe pattern along a direction (an x-axis direction shown in FIG. 14) crossing the first electrodes 84 and insulated from the first electrodes 84, first conductive layers 88 electrically connected to the first electrodes 84, second conductive layers 90 electrically connected to the second electrodes 86 and spaced from the first conductive layers 88, and electron emission regions 92 provided between the first conductive layers 88 and the second conductive layers 90.

Each electron emission region 92 includes a layer having a carbon-based material. In this case, the electron emission regions 92 may be composed of a material selected from the group consisting of carbon nanotubes, graphite, graphite nanofibers, diamond-like carbon, fullerene ($C_{60}$), and combinations thereof. In addition, the electron emission regions 92 may be formed as a small crevice or crack between the first conductive layer 88 and the second conductive layer 90.

In the above configuration, one first electrode 84, one second electrode 86, one first conductive layer 88, one second conductive layer 90, and one electron emission region 92 form one electron emission element. One electron emission element may correspond to one pixel area of the light emission device 106, or a plurality of electron emission elements may correspond to one pixel area of the light emission device 106.

When a driving voltage is applied to the first electrode 84 and the second electrode 86, a current flows through the first conductive layer 88 and the second conductive layer 90 in a direction substantially horizontal to a surface of the electron emission region 92, and surface-conduction emission is performed from the electron emission region 92.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A light emission device comprising:

a vacuum chamber comprising a first substrate, a second substrate spaced from and facing the first substrate, and a sealing member between the first substrate and the second substrate;

an electron emission unit on the first substrate, the electron emission unit comprising a plurality of electron emission elements;

a light emission unit on the second substrate, the light emission unit comprising a phosphor layer;

a barrier spaced from the sealing member between the first substrate and the second substrate;

a plurality of stud pins fixed on at least one of the sealing member or the barrier; and a getter unit attached to the stud pins and being fixed between the sealing member and the barrier, the getter unit comprising a plurality of getter containers each having a getter layer, a first support supporting at least one of the getter containers and a second support located between and integral with adjacent getter containers.

2. The light emission device of claim 1, wherein the first support is attached to one of the stud pins.

3. The light emission device of claim 2, wherein the first support comprises:

a horizontal portion attached to the getter container, the horizontal portion being substantially parallel to the first substrate and to the second substrate, and a vertical portion extending at an angle from the horizontal portion, the vertical portion having a through-hole through which one of the stud pins is inserted.

4. The light emission device of claim 1, comprising a plurality of first supports, wherein the plurality of getter containers are spaced from each other, and wherein a corresponding one of the plurality of first supports and a corresponding one of the plurality of stud pins are attached to only outermost getter containers of the plurality of getter containers.

5. The light emission device of claim 1, wherein the stud pins are spaced from each other on an inner surface of the sealing member or on a side surface of the barrier.

6. The light emission device of claim 1, wherein the stud pins comprise a plurality of stud pins on an inner surface of the sealing member and a plurality of stud pins on a side surface of the barrier, wherein each of the plurality of stud pins on the inner surface of the sealing member is aligned with a corresponding stud pin of the plurality of stud pins on the side surface of the barrier.

7. The light emission device of claim 1, wherein the stud pins comprise a plurality of stud pins on an inner surface of the sealing member and a plurality of stud pins on a side surface of the barrier, wherein none of the plurality of stud pins on the inner surface of the sealing member is aligned with any stud pin of the plurality of stud pins on the side surface of the barrier.

8. The light emission device of claim 1, wherein a height of the barrier is about equal to a height of the sealing member.

9. The light emission device of claim 1, wherein the electron emission element is one selected from a field emission array (FEA) type and a surface-conduction emission (SCE) type, and wherein the light emission unit further comprises an anode electrode on a surface of the phosphor layer for receiving an anode voltage of between about 10 and 15 kV.

10. A display device comprising:

a display panel for displaying an image; and a light emission device for providing light to the display panel, the light emission device comprising:

a vacuum chamber comprising a first substrate, a second substrate spaced from and facing the first substrate, and a sealing member between the first substrate and the second substrate;

an electron emission unit on the first substrate, the electron emission unit comprising a plurality of electron emission elements;

a light emission unit on the second substrate, the light emission unit comprising a phosphor layer;

a barrier spaced from the sealing member between the first substrate and the second substrate;

a plurality of stud pins fixed on at least one of the sealing member or the barrier; and a getter unit attached to the stud pins, the getter unit fixed between the sealing member and the barrier, the getter unit comprising a plurality of getter containers each having a getter layer, a first support supporting at least one of the getter containers and a second support located between and integral with adjacent getter containers.

11. The display device of claim 10, wherein the first support is attached to one of the stud pins.

12. The display device of claim 11, wherein the first support comprises:

a horizontal portion attached to the getter container, the horizontal portion being substantially parallel to the first substrate and to the second substrate, and a vertical portion extending at an angle from the horizontal portion, the vertical portion having a through-hole through one of the stud pins is inserted.

13. The display device of claim 10, comprising a plurality of first supports, wherein the plurality of getter containers are spaced from each other along a line, and wherein a corresponding one of the plurality of first supports and a corresponding one of the plurality of stud pins are attached to only outermost getter containers of the plurality of getter containers.

14. The display device of claim 10, wherein the stud pins are spaced from each other on an inner surface of the sealing member or on a side surface of the barrier.

15. The display device of claim 10, wherein a plurality of stud pins on an inner surface of the sealing member and a plurality of stud pins on a side surface of the barrier, and wherein each of the plurality of stud pins on the inner surface of the sealing member is aligned with a corresponding one of the plurality of stud pins on the side surface of the barrier.

16. The display device of claim 10, wherein the stud pins comprise a plurality of stud pins on an inner surface of the sealing member and a plurality of stud pins on a side surface of the barrier, and wherein none of the plurality of stud pins on the inner surface of the sealing member is aligned with any stud pin of the plurality of stud pins on the side surface of the barrier.

17. The display device of claim 10, wherein the display panel comprises a number of first pixels, wherein the light emission device comprises a number of second pixels, and wherein the number of second pixels is fewer than the number of first pixels.

18. The display device of claim 10, wherein the display panel is a liquid crystal display panel.

* * * * *